US005161668A

United States Patent [19]

Datema et al.

[11] Patent Number: 5,161,668

[45] Date of Patent: Nov. 10, 1992

[54] GUIDE MECHANISM FOR PASSENGER CONVEYORS

[75] Inventors: Douglas N. Datema; Thomas R. Nurnberg, both of Bettendorf, Iowa; Richard D. Rohret, East Moline, Ill.

[73] Assignee: Montgomery Electric Company, Moline, Ill.

[21] Appl. No.: 732,163

[22] Filed: Jul. 18, 1991

[51] Int. Cl.[5] ..... B66B 23/12

[52] U.S. Cl. ..... 198/332; 104/245; 104/247

[58] Field of Search ..... 198/332, 326, 327, 328, 198/329, 330, 333; 104/245, 247

[56] References Cited

U.S. PATENT DOCUMENTS

| | | | |
|---|---|---|---|
| 927,685 | 7/1909 | Seeberger | 198/332 |
| 3,682,289 | 8/1972 | Kraft | 198/332 |
| 4,895,239 | 1/1990 | Johnson et al. | 198/328 |

FOREIGN PATENT DOCUMENTS

| | | | |
|---|---|---|---|
| 303508 | 12/1932 | Italy | 104/245 |

*Primary Examiner*—Robert P. Olszewski
*Assistant Examiner*—Cheryl L. Gastineau
*Attorney, Agent, or Firm*—Wood, Phillips, VanSanten, Hoffman, & Ertel

[57] ABSTRACT

A guide mechanism for a passenger conveyor which includes a series of passenger platforms supported on and movable along a frame which has a support track for support rollers mounted on the platforms. The guide mechanism includes a monotrack guide rail, and a pair of horizontal pinch rollers supported by each passenger platform. The pinch rollers are in engagement with opposite sides of the monotrack guide rail. One of the pinch rollers is of a lower compression stiffness than the other pinch roller. The guide mechanism is coupled to a walking beam assembly wherein a pair of support rollers are mounted at opposite ends of a beam extending in the direction of movement of the conveyor, and the guide rail mechanism is coupled to the beam between the pair of support rollers.

22 Claims, 2 Drawing Sheets

GUIDE MECHANISM FOR PASSENGER CONVEYORS

FIELD OF THE INVENTION

This invention generally relates to the art of passenger conveyors such as escalators and moving walkways and, particularly, to a guide mechanism for the passenger platforms of such conveyors.

BACKGROUND OF THE INVENTION

A passenger conveyor typically includes a series of passenger platforms or steps which are driven in an endless path between horizontally spaced landings. The passenger conveyor includes a main body frame supported by the floors or other support structures of a building, for instance, and conventionally has track means for the passenger platforms to guide the platforms along a path between the landings Typically, the track means include a support track for support rollers mounted to the respective passenger platforms, and, in some instances, guide rollers movable along a guide track. Usually, the overall passenger conveyor construction includes a balustrade about which handrails are circulated in an endless path generally in synchronism with the movable platforms. Kick skirts conventionally run along opposite sides of the conveyor, with the passenger platforms being disposed between the skirts. Guide mechanisms in various forms normally are provided to maintain the moving passenger platforms spaced from the side skirts in order to avoid any dragging engagement between the platforms and the skirts.

One of the continuing and major problems with passenger platforms of the character described above, is the inability to maintain a consistently small clearance between the moving passenger platforms and the side skirts to prevent foreign objects from lodging therebetween and still prevent dragging engagement between the platforms and the skirts. Most uniform building codes require a 3/16 inch maximum clearance between the platforms and the skirts. This maximum limit is required to prevent most foreign objects from lodging in the side gaps between the platforms and the skirts However, that maximum limit still is insufficient to prevent many smaller objects from wedging into the gaps. It is known that the maximum clearance allowable under such uniform codes would be made smaller, but industry has not found any effective guide mechanism to reduce the clearance without creating dragging engagement between the platforms and the skirts. The tolerances during manufacture and/or assembly simply are too great for such massive components.

Heretofore, guide mechanisms for passenger conveyors predominantly have incorporated guide tracks and guide rollers mounted at opposite sides of the passenger platforms. Consequently, there must be a separate track setting at each side of each platform or a setting based on the distance between the horizontally spaced guide tracks and/or guide rollers In other words, these types of guide mechanisms could be called "bumper rail" systems in that there must be some allowance between the two opposite settings of each platform or else there would be a constant binding between the horizontally spaced, opposing guide mechanisms.

This invention is directed to solving the above problems by providing a monotrack guide rail system which has been found capable of reducing the gap clearance between the passenger platforms and the conveyor side skirts to on the order of 1/16 inch.

SUMMARY OF THE INVENTION

An object, therefore, of the invention is to provide a new and improved guide mechanism for a passenger conveyor of the character described.

Generally, the passenger conveyor includes a series of passenger platforms supported by and movable along a frame which includes a support track for support rollers mounted on the platforms. The support rollers are mounted on transverse axles disposed beneath the passenger platforms.

The invention contemplates the provision of a monotrack guide rail extending lengthwise of and defining the path of movement of the passenger conveyor. A pair of horizontal pinch rollers are supported by each passenger platform, and the pinch rollers are in engagement with opposite sides of the monotrack guide rail. Preferably, one of the pinch rollers is of a lower compression stiffness than the other pinch roller. This differential in compression stiffness between the rollers can be provided by fabricating the peripheries of the rollers of resilient material, such as urethane or the like, and with one of the pinch rollers having a narrower peripheral rail-engaging surface than the other pinch roller. Alternatively, one pinch roller may be fabricated of a softer material than the other pinch roller. Therefore, the pinch rollers can be mounted for constant gripping or pinching engagement with the monotrack guide rail, with the "harder" pinch roller defining a moving frame of reference along the singular guide track while the softer pinch roller biases against the guide rail.

In the exemplary embodiment of the invention, generally, the monotrack guide rail is illustrated as being formed unitarily with the support track for the support rollers of the conveyor The support track has a horizontal portion on which the support rollers are supported, and a vertical portion forming the monotrack guide rail for the pinch rollers The support rollers are journalled on an axle extending horizontally beneath each passenger platform. The pinch rollers are disposed in horizontal planes, i.e., rotatable about generally vertically axes, and depend from the support roller axle for pinching against opposite sides of the monotrack guide rail formed by the support track itself.

Another feature of the invention is the provision of an assembly which incorporates a "walking beam" operatively associated between the support rollers and the pinch rollers. More particularly, a short beam extends in the direction of movement of the conveyor and is journalled to a respective passenger platform by fixing the beam, intermediate its ends, to the support roller axle, with the axle journalled beneath the respective platform. A pair of support rollers are journalled on the beam at locations spaced in the direction of movement of the conveyor. The pinch rollers are supported by the axle, projecting from the axle, whereby the axes of rotation of the pinch rollers are fixed relative to the beam. This assembly provides for a smooth transition in an escalator-type passenger conveyor between horizontal portions of the escalator and inclined portions of the escalator, particularly horizontal and inclined portions of the support track.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
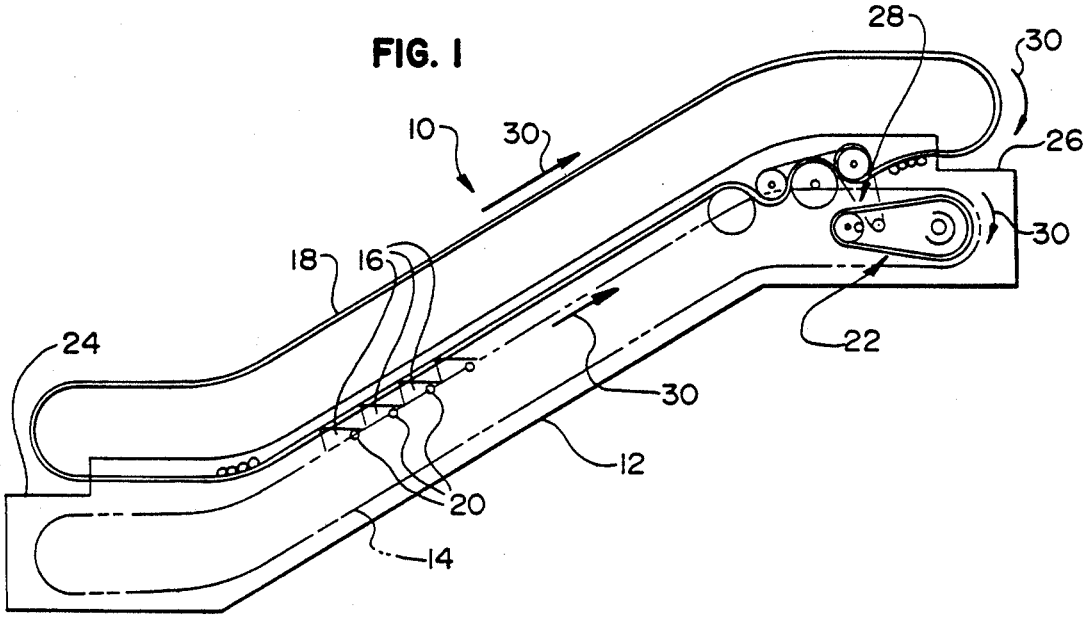
FIG. 1 is a somewhat schematic illustration of a typical escalator construction.

Referring to the drawings in greater detail, and first to FIG. 1, a general arrangement of a passenger conveyor in the form of a typical escalator, generally designated 10, is shown. The arrangement includes a stationary frame, schematically illustrated at 12, which mounts the conveyor to a support structure of a building, for instance. The frame supports a pair of horizontally spaced endless chains 14, a plurality of passenger platforms or steps, generally designated 16, drivingly engaged and movable by the chains, and a pair of horizontally spaced circuitous handrails 18. The passenger platforms are supported by a plurality of support rollers movable on a support track, as described in greater detail hereinafter. Suffice it to say, circles 20 in FIG. 1 simply are shown to illustrate some of the support rollers. The support track is appropriated fixed to stationary frame 12.

Chains 14 are moved by a conventional belt drive, generally designated 22, to continuously move passenger platforms 16 in a closed-loop path between a front or lower landing 24 and an upper or forward landing 26. A second belt drive mechanism, generally designated 28, drives handrail 18 in a closed-loop path in synchronism with the endless series of passenger platforms 16, as indicated by arrows 30, as a passenger stands on one of the platforms and grasps handrail 18.

It should be understood that the illustration of escalator 10 in FIG. 1, along with the above description thereof, is somewhat schematic in that the described components of the escalator are generally conventional. It must be understood that the invention is directed to a guide mechanism for use with passenger conveyors in general, including escalators, as described, as well as horizontal moving walkways and the like.

Figure 2:
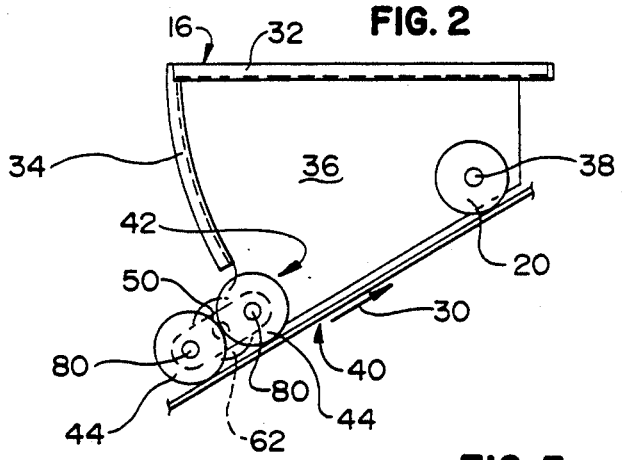
FIG. 2 is a side elevational view of one of the escalator steps, primarily illustrating the locations of the support rollers and support track for the steps.

Referring to FIG. 2, the position of one of the support rollers 20 (FIG. 1) in relation to one of the passenger platforms or steps 16 is illustrated in greater detail. Each step 16 includes a top platform portion 32, a front arched wall 34 and a pair of side walls 36. Support roller 20 is journalled at a forward (in relation to the direction of movement of the conveyor as indicated by arrow 30) area of the step, as by journalling the roller on a shaft 38 and appropriate bearing means in wall 36. The roller moves along a support track, generally designated 40. A trailing support roller assembly, generally designated 42, is mounted on the passenger platform and includes a pair of support rollers 44 supported on and movable along support track 40. The support track is appropriately fixed to stationary frame of the conveyor.

Figure 3:
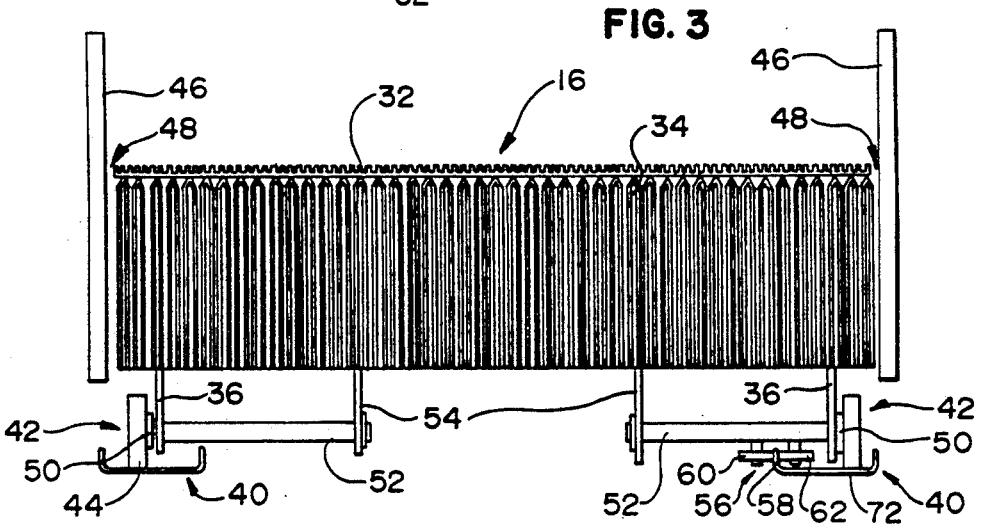
FIG. 3 is a front elevational view, looking toward the left-hand side of FIG. 2.

FIG. 3 shows how passenger platform 16 is located between a pair of kick skirts 46 of the conveyor system, defining gaps 48 between the sides of the platform and the skirts. It also can be seen that side walls 36 of platform 16 are recessed inwardly of the outer bounds of platform portion 32 and front arched wall 34 of each step. The location of support track 40 and support roller mechanism 42 also are more clearly shown.

Still referring to FIG. 3, it can be seen that there is a support roller assembly 42 at each opposite end of passenger platform 16, and a support track 40 extends along the conveyor at each opposite side thereof. Support rollers 42 are journalled by appropriate bearings at opposite ends of a relatively short walking beam 50 (see FIG. 2) which is fixed to an outer end of an axle 52. The axle is journalled by appropriate bearings in side wall 36 and an inner wall 54 projecting downwardly from passenger platform 16. This same arrangement is provided for support rollers 44 at both sides of passenger platform 16 as seen in FIG. 3. The walking beam construction will be described in greater detail hereinafter, in relation to FIGS. 5-7.

Figure 4:
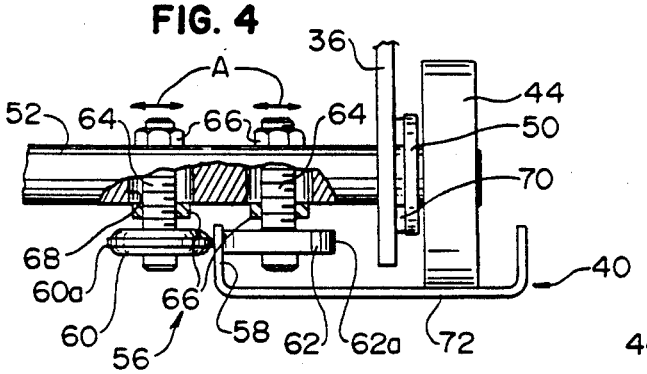
FIG. 4 is an enlarged depiction of the guide mechanism of the invention, illustrated at the bottom right-hand portion of FIG. 3.

Referring to FIG. 4 in conjunction with FIG. 3, the invention contemplates a guide mechanism, generally designated 56, for each passenger platform to guide the series of conveyor platforms between skirts 46 (FIG. 3) and maintain a minimal clearance at gaps 48 between the passenger platforms and the skirts.

More particularly, guide mechanism 56 includes a monotrack guide rail 58, and a pair of horizontal pinch rollers 60 and 62. The pinch rollers are rotatable about vertical axes defined by stub shafts 64 clamped to axle 52 by externally threading the stub shafts and employing clamping nuts 66. Therefore, for purposes described hereinafter, when axle 52 rotates slightly about its axis, stub shafts 64 and pinch rollers 60 and 62 will move therewith.

It can be seen that pinch rollers 60 and 62 are in pinching engagement with opposite sides of monotrack guide rail 58. Initial setting of the pinch rollers into a tight pinching engagement with the guide rail is afforded by slightly elongated slots 68 in axle 52 whereby the pinch rollers can be initially set or subsequently adjusted in the direction of double headed arrows "A".

The invention also contemplates that provision can be made to provide a degree of yielding between the pinch rollers to accommodate any variances in the guide rail system. In the preferred embodiment, one pinch roller 60 is of a lower compression stiffness than the other pinch roller 62. This differential in compression stiffness can be provided by fabricating the pinch rollers of yieldable material, such as a rubber-type material, with pinch roller 60 having a lower Durometer rating than pinch roller 62. In other words, pinch roller 60 would be softer than pinch roller 62. In the exemplary embodiment illustrated in FIG. 4, the rollers are fabricated of steel or like material, journalled by appropriate bearing means on stub shafts 64, and are covered by a urethane material. It can be seen that the periphery of pinch roller 60, i.e., its urethane covering, is formed to have a narrower peripheral rail-engaging surface than pinch roller 62. Specifically, the urethane cover of roller 60 is molded to define a narrow rib 60*a*, whereas roller 62 has a wider, flat peripheral surface 62*a*. In this manner, it also is contemplated that the stub shaft 64 for roller 62 can be fixed longitudinally of axle 52, rather than being longitudinally adjustable, as shown, with stub shaft 64 and, consequently, pinch roller 60 being axially adjustable of the axle since pinch roller 60 is the softer roller. FIG. 4 also shows a bearing 70 disposed between walking beam 50 and side wall 36.

Still referring to FIG. 4, in conjunction with FIG. 3, in the illustrated embodiment of the invention, monotrack guide rail 58 is fabricated as a unitary portion of support rail 40. As shown, the support rail is generally U-shaped and includes a horizontal portion 72 on which support rollers 44, as well as support roller 20 (FIG. 2) are supported. Monotrack guide rail 58 is formed by one leg of the U-shaped support rail. By forming the monotrack guide rail and the support rail in a single-piece construction, the guide mechanism is quite cost effective, and a degree of stability is provided between the entire arrangement of the guide mechanism and the support roller assembly.

Figure 7:
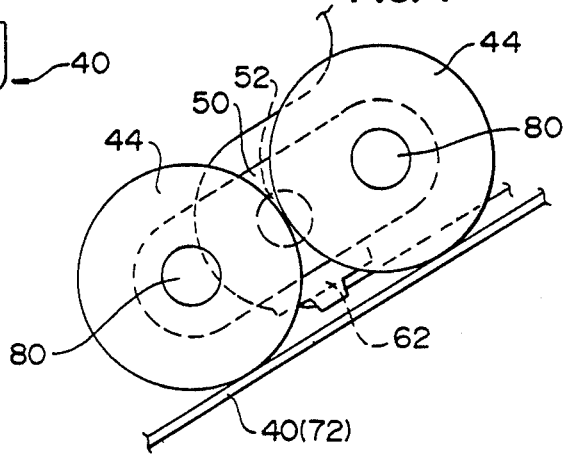
FIG. 7 is a view similar to that of FIGS. 5 and 6, with the support rollers on an inclined portion of the support track.
Figure 6:
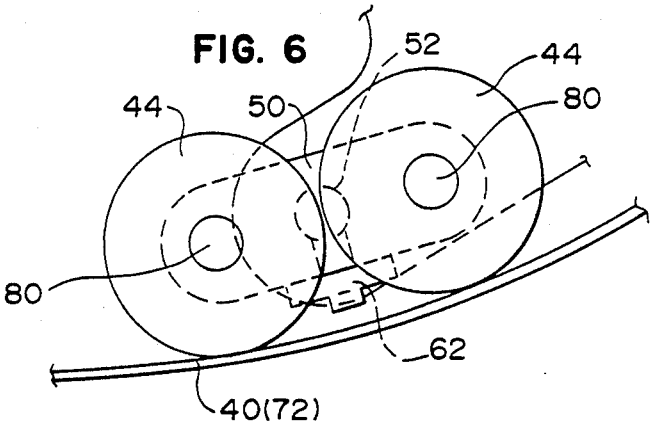
FIG. 6 is a view similar to that of FIG. 5, with the support rollers on a transition portion of the support track.
Figure 5:
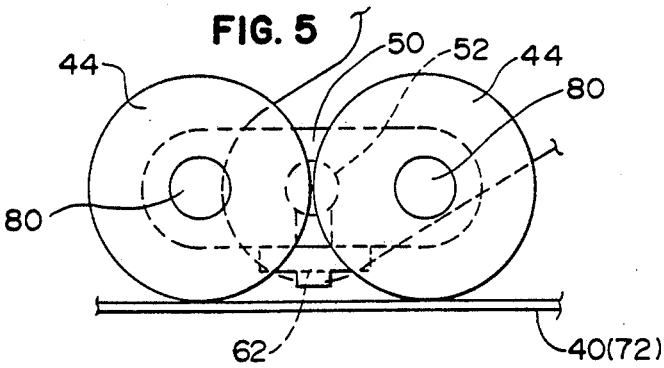
FIG. 5 is a side elevational view of the walking beam arrangement, with the support rollers on a level portion of the support track.

Referring to FIGS. 5–7 in conjunction with FIG. 4, it should be understood that walking beam 50 is fixed to axle 52 and, as described above, stub shafts 64 also are fixed to the axle. Consequently, all of the these components can move or "tilt" in unison as support rollers 44 move along different portions 72 of support track 40, the support rollers being journalled to the end of axle 52.

FIGS. 5–7 show how the walking beam arrangement, operatively associated between support rollers 44 and pinch rollers 60 and 62, are functional in moving between a level portion (FIG. 5) of the support track, through a transition portion (FIG. 6) of the support track, to an inclined portion (FIG. 7) of the support track. These areas of transition coincide with the configuration of escalator 10 shown in FIG. 1. In other words, as is conventional with most escalators, there is an initial level portion of the escalator adjacent landing 24 (FIG. 1) which leads to the inclined area of the escalator comprising the majority of the length thereof, and ending in another level area at the top of the escalator near landing 26. The walking beam arrangement is provided to afford a smoother transition in these areas as well as to smooth out the "ride" should there be any irregularities in the support track system of the escalator. This is particularly advantageous for escalators because passengers are prone to stand on the very edge of the passenger platforms or steps where any nonuniform or abrupt movement of the steps is magnified into an imbalance for a passenger. Mechanically, the walking beam arrangement and the two support rollers, in essence, reduce by one-half the affect of irregularities in the track system or in the transition areas between the level and inclined portions of the escalator.

As seen in FIG. 5, support rollers 44 are on a level portion of support track 40, i.e., the horizontal portion 72 of the track. Consequently, walking beam 50 is level or generally horizontal since the support rollers are journalled, as at 80, to horizontally space portions of the walking beam.

FIG. 6 shows the walking beam arrangement with support rollers 44 moving through a transition portion of the support track from the level portion shown in FIG. 5 to the inclined portion shown in FIG. 7. In essence, the forward support roller 44 moves into the inclined portion of the track while the rear support roller still is on the level portion of the track. It can be seen that axle 52 is disposed equidistant between the axes of rotation of support rollers 44. Therefore, the axle will move through the transition at one-half the rate of either roller, smoothing out the "ride" of the respective passenger platform and any passenger standing thereon. It also can be seen in FIG. 6 how stub shafts 64 and pinch rollers 60 and 62 will tilt with axle 52 in unison with the movement of the entire assembly through the transition area.

FIG. 7 shows the walking beam arrangement moving up the inclined portion of the support track with support rollers 44, walking beam 50, axle 52, and pinch rollers 60 and 62 resuming their relative positions as shown by the "level" or horizontal depiction of FIG. 5.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A guide mechanism for a passenger conveyor, the conveyor including a series of passenger platforms supported on and movable along a frame which includes a support track for support rollers mounted onthe platforms, the guide mechanism comprising:

a guide rail fixed to the frame; and a pair of horizontal pinch rollers supported by each passenger platform, the pinch rollers in each pair being in engagement with opposite sides of the guide rail, one of the pinch rollers in a first pinch roller pair being normally in a first position relative to the guide rail, the other of the pinch rollers in the first pinch roller pair being normally in a second position relative to the guide rail; and means associated with at least one of the pinch rollers on the first pinch roller pair for allowing at least one of the pinch rollers in the first pinch roller pair to be moved relative to the guide rail from one of its first and second positions relative to the guide rail as to accommodate variances in the guide rail system.

2. A guide mechanism for a passenger conveyor, the conveyor including a series of passenger platforms supported on and movable along a frame which includes a support track for support rollers mounted on the platforms, the guide mechanism comprising:

a monotrack guide rail fixed to the frame; and a pair of horizontal pinch rollers supported by each passenger platform, the pinch rollers being in engagement with opposite sides of the guide rail, wherein one of said pinch rollers is of a lower compression stiffness than the other pinch roller.

3. The guide mechanism of claim 2 wherein said lower compression stiffness of the one pinch roller is provided by the one pinch roller having a narrower peripheral rail-engaging surface than the other pinch roller.

4. The guide mechanism of claim 2 wherein said one pinch roller is fabricated of softer material than the other pinch roller.

5. The guide mechanism of claim 1 wherein said guide rail is formed unitarily with the support track for the support rollers.

6. The guide mechanism of claim 1 wherein the support rollers are mounted on the passenger platforms by a transverse axle, and wherein said pinch rollers are mounted on the axle.

7. The guide mechanism of claim 6 wherein the support track of the conveyor includes a portion thereof forming said guide rail.

8. The guide mechanism of claim 7 wherein said support track includes a horizontal poriton on which said support rollers are supported and a vertical portion forming the guide rail.

9. A guide mechanism for a passenger conveyor, the conveyor including a series of passenger platforms supported on and movable along a frame which includes a support track for support rollers mounted on the platforms, the guide mechanism comprising:

a monotrack guide rail fixed to the frame; and a pair of horizontal pinch rollers supported by each passenger platform, the pinch rollers being in engagement with opposite sides of the monotrack guide rail, wherein the support rollers are mounted on the passenger platforms by a transverse axle, and wherein said pinch rollers are mounted on the axle, wherein the support track of the conveyor includes a portion thereof forming said monotrack guide rail, wherein said support track includes a horizontal portion on which said support rollers are supported and a vertical portion forming the monotrack guide rail, wherein the passenger platform includes a vertical wall, and the support rollers are mounted outside the wall and the pinch rollers are mounted inside the wall.

10. A guide mechanism for a passenger conveyor, the conveyor including a series of passenger platforms supported on and movable along a frame which includes a support track for support rollers mounted on the platforms, the guide mechanism comprising:

a monotrack guide rail fixed to the frame; and a pair of horizontal pinch rollers supported by each passenger platform, the pinch rollers being in engagment with opposite sides of the monotrack guide rail, wherein the support rollers are mounted on the passenger platforms by a transverse axle, and wherein said pinch rollers are mounted on the axle, wherein the passenger platform includes a vertical wall, and the support rollers are mounted outside the wall and the pinch rollers are mounted inside the wall.

11. A guide mechanism for a passenger conveyor, the conveyor includinga series of passenger platforms supported on and movable along a frame which includes a support track for support rollers mounted on the platforms, the guide mechanism comprising:

a monotrack guide rail fixed to the frame; and a pair of horizontal pinch rollers supported by each passenger platform, the pinch rollers being in engagement with opposite sides of the monotrack guide rail, wherein the passenger platform includes a vertical wall, with the support rollers being mounted outside the wall, and wherein said monotrack guide rail and the pinch rollers are located inside the wall.

12. A guide mechanism for a passenger conveyor, the conveyor including a series of passenger platforms supported on and movable along a frame which includes a support track for support rollers mounted on the platforms, the guide mechanism comprising:

a monotrack guide rail fixed to the frame; and a pair of horizontal pinch rollers supported by each passenger platform, the pinch rollers being in engagement with opposite sides of the monotrack guide rail, wherein the support rollers are part of a support roller assembly for each passenger platform, each roller assembly including a beam extending in the direction of movement of the conveyor and journalled intermediate its ends to its respective passenger platform, and a pair of support rollers journalled on the beam at locations spaced in said direction, and wherein said pinch rollers are supported by axle means projecting from the beam at a midpoint of the beam between the axes of rotation of the support rollers.

13. A guide mechanism for a passenger conveyor, the conveyor including a series of passenger platforms supported by and movable along a frame which includes support track means for support rollers mounted on the platforms, the passenger platforms being disposed between side skirts of the conveyor, the guide mechanism comprising:

said support track means being defined by a support track which includes a horizontal portion on which said support rollers are supported, and a vertical portion forming a monotrack guide rail; and a pair of horizontal pinch rollers supported by each passenger platform, the pinch rollers being in engagement with opposite sides of the monotrack guide rail, wherein one of said pinch rollers is of a lower compression stiffness than the other pinch roller.

14. The guide mechanism of claim 13 wherein said lower compression stiffness of the one pinch roller is provided by the one pinch roller having a narrower peripheral rail-engaging surface than the other pinch roller.

15. The guide mechanism of claim 13 wherein said one pinch roller is fabricated of softer material than the other pinch roller.

16. A guide mechanism for a passenger conveyor, the conveyor including a series of passenger platforms supported by and movable along a frame which includes support track means for support rollers mounted on the platforms, the passenger platforms being disposed between side skirts of the conveyor, the guide mechanism comprising:

said support track means being defined by a support track which includes a horizontal portion on which said support rollers are supported, and a vertical portion forming a monotrack guide rail; and a pair of horizontal pinch rollers supported by each passenger platform, the pinch rollers being in engagement with opposite sides of the monotrack guide rail, wherein the support rollers are part of a support roller assembly for each passenger platform, each roller assembly including a beam extending in the direction of movement of the conveyor and journalled intermediate its ends to its respective passenger platform, and a pair of support rollers journalled on the beam at locations spaced in said direction, wherein said pinch rollers are supported by axle means projecting from the beam at a mid-point of the beam between the axes of rotation of the support rollers.

17. A guide mechanism for a passenger conveyor, the conveyor including a series of passenger platforms supported on and movable along a frame, comprising:

a vertical guide rail; and a pair of horizontal pinch rollers rotatable about generally vertical axes and supported by each passenger platform, the pinch rollers being in engagement with opposite sides of the vertical guide rail, wherein one of said pinch rollers is of a lower compression stiffness than the other pinch roller.

18. The guide mechanism of claim 17 wherein said lower compression stiffness of the one pinch roller is provided by the one pinch roller having a narrower peripheral rail-engaging surface than the other pinch roller.

19. In a passenger conveyor which includes a series of passenger platforms supported on and movable along a frame in an endless path, a support roller system comprising:

a support track extending along the conveyor in the direction of movement thereof and having an endless guide surface;

a beam operatively associated with each passenger platform, each beam exteding in the direction of movement of the conveyor and journalled for rotation about a first axis intermediate its ends to its respective passenger platform;

a pair of support rollers journalled for rotation about spaced second and third axes on each beam at locations spaced on opposite sides of the first beam axis, the support rollers being simultaneously supported by the support track surface throughout the range of movement of the platforms in the endless path.

20. In a passenger conveyor as set forth in claim 19, including a guide mechanism for each passenger platform to guide the platform in said direction, the guide mechanism being operatively fixed to the respective beam of each platform.

21. A passenger conveyor which includes a series of passenger platforms supported on and movable along a frame, a support roller system comprising:

a support track extending along the conveyor in the direction of movement thereof;

a beam operatively associated with each passenger platform, each beam extending in the direction of mvoement of the conveyor and journalled intermediate its ends to its respective passenger platform;

a pair of support rollers journalled on each beam at locations spaced on opposite sides of a point where the beam is journalled to its respective passenger platform, the support rollers being supported by the support track; and a guide mechanism for each passenger platform to guide the platform in said direction, the guide mechanism being operatively fixed to the respective beam of each platform, wherein said guide mechanism includes a monotrack guide rail and a pair of pinch rollers supported by each passenger platform, the pinch rollers being coupled to the beam and in engagement with opposite sides of the guide rail.

22. In a passenger conveyor as set forth in claim 21 wherein said guide rail is formed unitarily with said support track for the support rollers.

* * * * *

UNITED STATES PATENT AND TRADEMARK OFFICE

CERTIFICATE OF CORRECTION

PATENT NO. : 5,161,668

DATED : November 10, 1992

INVENTOR(S) : Douglas N. Datema et al

It is certified that error appears in the above-identified patent and that said Letters Patent is hereby corrected as shown below:

On the title page, Item [73]: the correct name of the assignee is: Montgomery Elevator Company Signed and Sealed this Twenty-sixth Day of October, 1993

*Attest:*

Bruce Lehman

BRUCE LEHMAN

*Attesting Officer*

*Commissioner of Patents and Trademarks*